United States Patent [19]

Lee, Jr.

[11] 4,316,375

[45] Feb. 23, 1982

[54] APPARATUS FOR CORRUGATING CAN BODY FLANGES

[75] Inventor: Harry W. Lee, Jr., Richmond, Va.

[73] Assignee: Reynolds Metals Company, Richmond, Va.

[21] Appl. No.: 196,670

[22] Filed: Oct. 14, 1980

Related U.S. Application Data

[62] Division of Ser. No. 99,099, Nov. 30, 1979, Pat. No. 4,266,685.

[51] Int. Cl.[3] ..... B21D 15/06

[52] U.S. Cl. ..... 72/105

[58] Field of Search ..... 72/94, 105, 106

[56] References Cited

U.S. PATENT DOCUMENTS

| | | | |
|---|---|---|---|
| 79,735 | 7/1868 | DeWitt | 72/105 |
| 220,991 | 10/1879 | Ross | 72/105 |
| 327,254 | 9/1885 | Graves | 220/72 |
| 1,321,885 | 11/1919 | Cameron | 72/105 |
| 1,643,252 | 9/1927 | McCrery | 220/66 |
| 1,649,292 | 11/1927 | Draper | 220/72 |
| 1,655,778 | 1/1928 | Bezzenberger | 72/105 |
| 1,792,812 | 2/1931 | Cameron | 72/94 |
| 1,839,272 | 1/1932 | Sinko | 220/72 |
| 2,019,360 | 10/1935 | Punte | 220/1 BC |
| 3,268,109 | 8/1966 | Coppens | 220/72 |
| 3,315,939 | 4/1967 | Catalano et al. | 220/72 X |
| 3,472,418 | 10/1969 | Ullman | 220/72 |
| 3,765,351 | 10/1973 | Kubacki et al. | 113/120 AA |
| 3,786,957 | 1/1974 | Hilgenbrink | 220/83 |
| 3,995,572 | 12/1976 | Saunders | 113/120 H |
| 4,058,998 | 11/1977 | Franck et al. | 72/84 |
| 4,070,888 | 1/1978 | Gombas | 72/105 |
| 4,120,419 | 10/1978 | Saunders | 220/1 BC X |

*Primary Examiner*—Lowell A. Larson

*Attorney, Agent, or Firm*—Lyne, Girard & McDonald

[57] ABSTRACT

A can body suitable for inward necking of the flange region is disclosed in which the flange region thereof includes a plurality of corrugations to increase the effective thickness and thus the stiffness of the metal in this flange region. A method and apparatus for producing these can bodies are also disclosed. The apparatus employed includes a pair of generally circular matched die members which are positioned on either side of the flange region of the can body to be corrugated and a means for rotating the can body, and thus the die members, when contacting the flange region of the can body.

1 Claim, 4 Drawing Figures

APPARATUS FOR CORRUGATING CAN BODY FLANGES

This application is a division of Ser. No. 99,099 filed Nov. 30, 1979, now U.S. Pat. No. 4,266,685 granted May 12, 1981.

BACKGROUND OF THE INVENTION

For many years, beverages, such as soft drinks and beer, have been packaged in metallic containers or cans. Originally, these metallic cans were formed of flat tin plated steel which was formed into a cylinder and sealed, by means such as soldering, welding or other sealing means, to form a side seam. A can bottom end was then seamed to the cylindrical body, the can was filled, and another can end top was seamed to complete the structure.

More recently, one-piece can bodies, formed of either aluminum or steel, have become widely used. These can bodies are formed by drawing and ironing a circular blank or slug of metal into a one-piece can body, by methods now well-known in the art. After forming this one-piece can body, the can body is filled with product and a can end, with or without an easy-opening feature thereon, is seamed to the can body to complete the structure.

Originally, both in the three-piece steel can and the two-piece aluminum or steel can, the can ends were of a somewhat greater diameter than the can body itself and thus extended axially outwardly beyond the walls of the can body. Because of this structure, when palletizing or otherwise shipping or storing filled can bodies, the effective volume of the filled can was a cylinder having the diameter of the can end, resulting in much wasted space.

To reduce the shipping and storage volume, it has now become a common practice, at least with respect to the two-piece can body, and to a somewhat lesser extent with respect to the three-piece can body, to form a reduced diameter flange portion on the can body. This practice is referred to as necking of the can body. The flange portion is necked inwardly to a reduced diameter such that the can body will accept an end of a diameter no greater than the can body diameter itself. Thus, the shipping and storage volume of the can body has been reduced to the volume of a cylinder of the diameter of the body itself.

To further reduce costs and the amount of metal in cans, double or even triple necking of the can flange region has been accomplished. In such can bodies, the final flange region diameter is reduced to accept an end having a diameter even less than the diameter of the can bodies themselves.

Necking of can bodies, however, presents problems in the design and fabrication of the can body. The necking of a can body is a diameter reduction process which supports the metal in the flange region only on the outside surface of the can body while compressing the metal. The metal is thus prevented from wrinkling only by the internal stiffness of the material itself. On the other hand, it is desired to form the can bodies having as thin a wall thickness as possible, for reduced metal usage and lighter weight and thus lower production and shipping costs. Currently, these competing forces are compromised by ironing the side wall thicknesses, in aluminum cans, to a thickness in the range of approximately 0.004 inch (0.0102 centimeters) while maintaining the thickness of the flange region in the range of approximately 0.0075 inch (0.0191 centimeters), by use of a tapered punch which carries the can body as it is ironed between the punch and ironing dies. However, such a tapered punch must be carefully machined and is subject to wear.

The metal in the flange region is, of course, additional metal which must be supplied in the metal disc or slug used to form the container, as well as providing extra weight for the container. Thus, it is a primary object of the present invention to enable reduction of the wall thickness of the necked-in flange region of a can body.

As previously mentioned, the successful necking of can bodies relies upon the stiffness of the material being formed. For a simple beam, the deflection of a metal member varies with the following formula:

$$Y = \frac{WL^3}{48EI}$$

where:

W is the width of the beam

L is the length of the beam

E is a constant for the material employed and

I is the moment of inertia.

The moment of inertia for a beam is:

$$I = \frac{WT^3}{3}$$

where:

W is the width of the beam and

T is the thickness of the beam.

Thus, substituting for I, the deflection of the beam becomes:

$$Y = \frac{3WL^3}{48EWT^3}$$

or:

$$Y = \frac{L^3}{16ET^3}$$

The stiffness of a beam is inversely proportional to its deflection. Thus, the stiffness of a beam varies as the cube of its thickness. For example, if the flange thickness of a can body is reduced about 8.7% from 0.0075 inch (0.0191 centimeters) to 0.0065 inch (0.0165 centimeters), the stiffness of this flange area is decreased by approximately 35%, which is also approximately equal to the percentage of increase in the tendency for this area to wrinkle. It is thus a primary purpose of the present invention to increase stiffness of the metal in the flange region of a can body by increasing the effective thickness of this flange region, while at the same time decreasing its absolute thickness. This then results in a reduction in metal usage, metal cost and weight while maintaining or increasing structural strength.

THE PRESENT INVENTION

By means of the present invention, such a can body is provided. The can body of the present invention includes a flange or edge region which is eventually to be inwardly necked and which includes a plurality of corrugations. These corrugations act to increase the effective thickness of the metal in the flange region so as to increase the stiffness thereof and decrease deflection and wrinkling. Thus, thinner flange regions may be employed which use less metal than previously required, and/or cylindrical, rather than tapered, punches may be employed in forming the can body.

A method and apparatus for producing this container includes a pair of generally circular matched die members which are positioned on the inside and the outside of the can flange region, means for contacting the die members with the can body, and a means for rotating the can body, with the matched corrugating dies, to produce the corrugated can edge or flange.

The corrugated flange can body of the present invention may be employed in a single, double or even triple necking operation to reduce the opening diameter of the can body and accept smaller diameter can ends without wrinkling of the necked flange region.

BRIEF DESCRIPTION OF THE DRAWINGS

The can body, method and apparatus of the present invention will be more fully described with reference to the drawings in which.

DETAILED DESCRIPTION OF THE PREFERRED EMBODIMENTS

Figure 1:
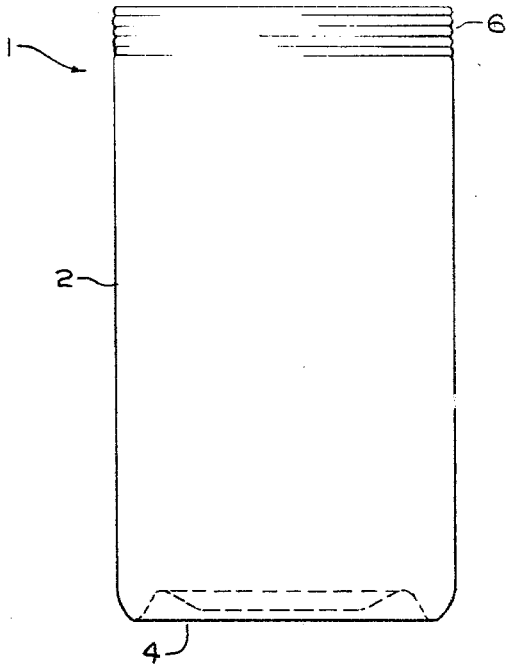
FIG. 1 is a front elevational view of a can body having a corrugated flange region, according to the present invention.

Turning to FIG. 1, a can body 1 formed according to the present invention is illustrated. The can body 1 includes a generally cylindrical side wall 2, a contoured bottom-closing portion 4 and a flange region 6. The flange region 6 is formed of a plurality of corrugations in the metal forming the side wall 2.

The can body 1 is preferably a drawn and ironed can body having the bottom-closing portion 4, as illustrated. This can body 1 may be formed of either aluminum or steel and may have a side wall thickness ranging from about 0.0030 to 0.0055 inches (0.0076 to 0.0140 centimeters), a bottom wall thickness ranging from about 0.0120 to 0.020 inches (0.0305 to 0.0508 centimeters) and a flange thickness ranging from about 0.0055 to 0.0090 inches (0.0140 to 0.0229 centimeters). Such a can body will be fitted with a can end, according to practices common in the can forming art, after filling of the can 1.

The can body could also be formed of a cylinder formed from a sheet of metal, such as steel, in which case a corrugated flange region 6 would be located at both ends of the cylindrical can body.

Figure 4:
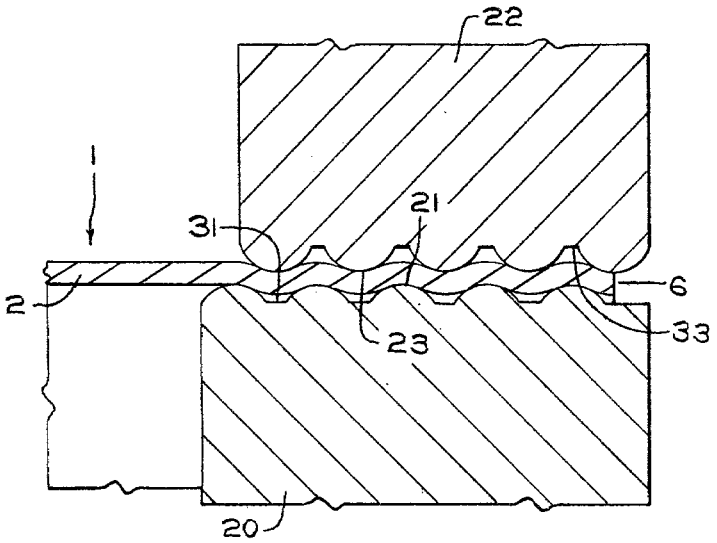
FIG. 4 is an exploded cross-sectional view taken through line 4—4 of FIG. 3 illustrating the corrugating dies employed in the method and apparatus of the present invention.
Figure 2:
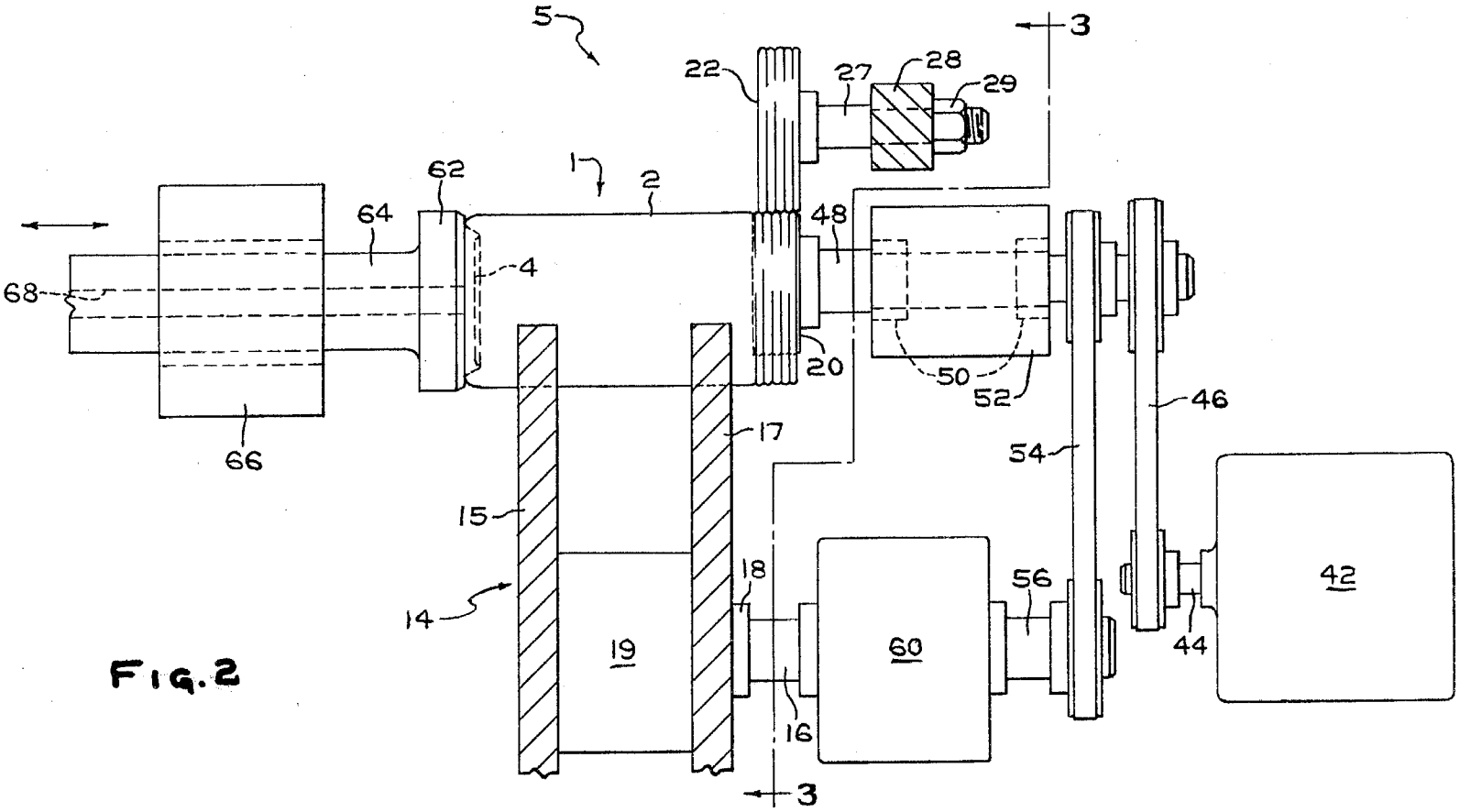
FIG. 2 is a cross-sectional view taken through line 2—2 of FIG. 3 illustrating the method and apparatus of the present invention.
Figure 3:
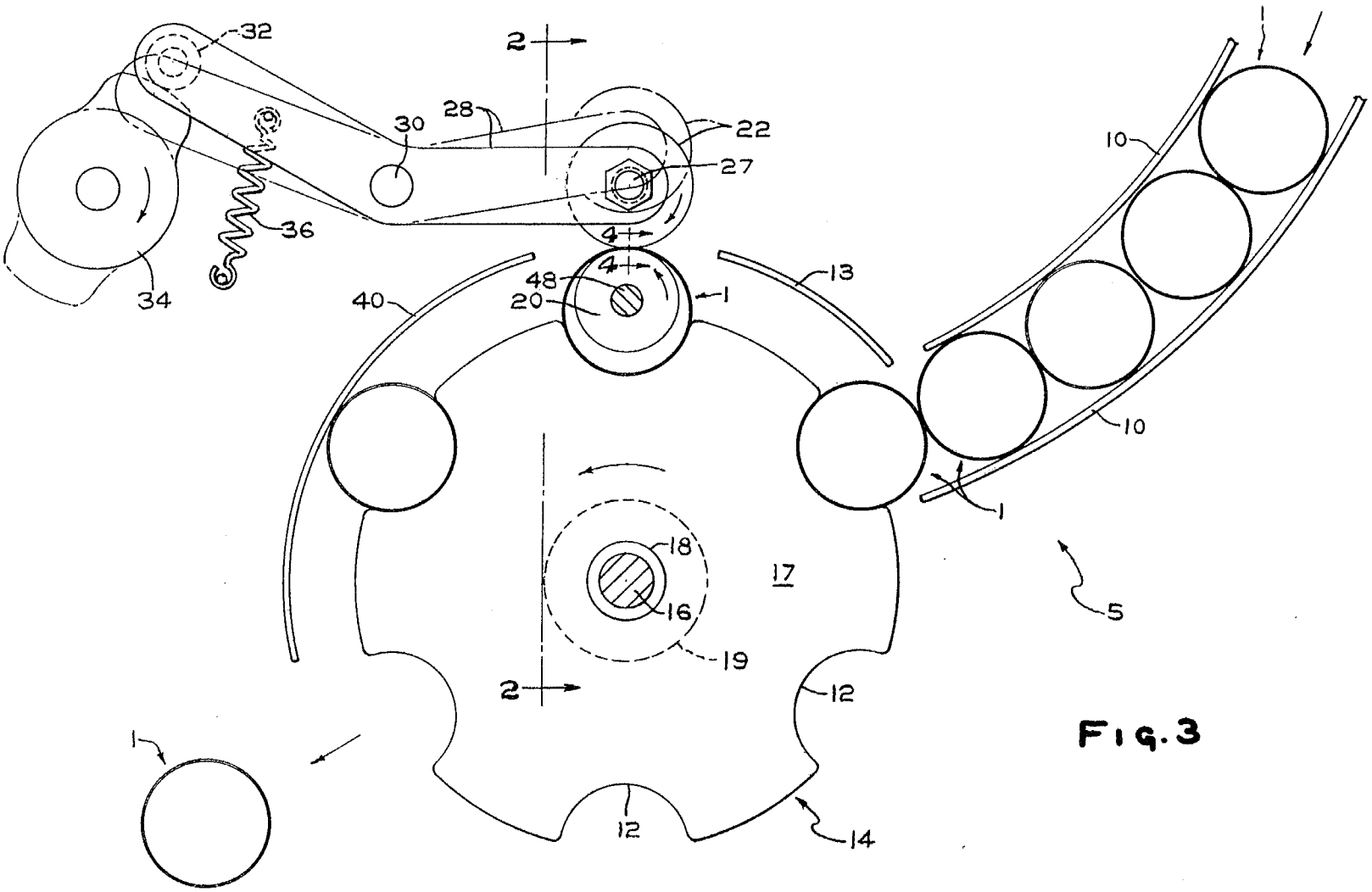
FIG. 3 is a partial cross-sectional view taken through line 3—3 of FIG. 2 illustrating the method and apparatus of the present invention.

The method and apparatus for forming the can body 1 as illustrated in FIG. 1 is more fully illustrated in FIGS. 2–4. Turning to these FIGURES, can bodies 1 are fed by means such as gravity from an infeed chute 10 to the flange corrugating apparatus, generally illustrated as 5. This apparatus 5 includes a starwheel 14 having a plurality of pockets 12. Such starwheels are commonly employed for indexing can bodies through a plurality of work stations. As the starwheel 14 indexes, can bodies 1 are sequentially positioned at the corrugating work station. The can bodies 1 pass from the feed station past a guide plate 13 to the corrugating work station. When the can body 1 reaches the corrugating work station, the bottom-closing portion 4 is contacted by centering plate 62. Centering plate 62 includes a vacuum line 68, which is connected to a source of vacuum (not shown) to firmly hold the bottom-closing portion 4 against the centering plate 62. The plate 62 and can body 1 are moved forward by means of piston 64, which is mounted within a mounting 66 and which is timed to reciprocate by a timing means (not shown). When the can body 1 is advanced, the inside of the flange portion 6 is in contact with an internal grooving roll 20, which roll 20 is fixedly mounted in place. At the same time, an outer grooving roller 22 contacts the outside of the flange region 6 of the can body 1. The outer grooving roller 22 is mounted for upward and downward reciprocation on an arm 28 which is pivoted about mounting 30. The arm 28 is biased, such as by a spring means 36, to a normally upward position and is reciprocated downwardly to contact the can body 1 by means of a cam 34 and cam follower 32, which are timed to move the outward grooving roller 22 into position when the can body is advanced by the piston means 64.

As can best be seen in FIG. 2, a motor 42 drives the inner grooving roller 20 by means such as a belt 46 connected to a shaft 48. Shaft 48 is mounted within bearings 50. The outer grooving roller 22, which is mounted by means of shaft 27 to mounting arm 28 and is free-wheeling. Thus, outer grooving roller 22, due to its frictional contact with the can body 1 when the cam 34 positions outer grooving roller 22 in its operating position, rotates when the can body 1 and, in conjunction with inner grooving roller 20 produces a corrugated flange region 6.

The corrugating operation can best be seen in FIG. 4. In this FIGURE, the flange region 6 of the side wall 2 of the can body 1 is shown between the inner grooving roller 20 and the outer grooving roller 22, in exploded view. Each of the grooved rollers 20 and 22 are formed of a material such as carbide or tool steel and the like, which material is substantially harder than the can body 1 and thus will not be substantially marred by the can body 1. Each of the grooved rollers 20 and 22 include a plurality of matched male grooving members 21 and 23 and female grooving members 31 and 33, respectively. The can body 1 is preferably rotated somewhat in excess of one complete revolution between the rollers 20 and 22, to assure complete formation of the corrugated flange region 6. As illustrated, the corrugations produced are parallel to one another on a radius perpendicular to the axis of the can body 1. However, these grooves could be spiral or take other desired shapes.

Returning to FIG. 2, the motor 42 is also connected, such as by belt means 54 and shaft 56, to an indexing box 60. Indexing box 60, as is well-known in the can transport art, produces indexed movements of the starwheel 14 through shaft 16. Thus, the indexing box may be designed to produce one indexed movement of the starwheel 14 for a given number of rotations of shaft 56, as desired.

The motor 42 may also be connected to cam 34 and to piston 64 to time these motions with the rotation of the can body 1 and the starwheel 14. Independent timing means for piston 64 and the cam 34 may also be employed.

After having been corrugated in the manner according to the present invention, the can body 1 may be necked according to principles well-known in the art. Thus, for example, such operations as those disclosed in U.S. Pat. Nos. 3,786,957 or 4,058,998 may be employed to form one or more diameter-reducing necks in the flange region 6 of the can body 1.

As can best be seen in FIG. 4, the tip-to-tip distance of the corrugated flange region 6 is greater than the thickness of the metal forming side wall 2. It is this "effective thickness" of the corrugated flange region 6 which permits added strength to reduce wrinkling during necking and which permits the use of a thinner flange than previously possible. Of course, the corrugated "effective thickness" does not provide as much stiffness as a solid wall of that thickness, but does provide sufficient additional stiffness and strength to permit double and even triple necking without additional metal or wrinkling.

From the foregoing, it is clear that the present invention provides a can body, and a method and apparatus for forming the same, of increased strength and with ease of forming.

While presently preferred embodiments of the present invention have been illustrated and described, it will be understood that the invention may be otherwise variously embodied and practiced within the scope of the following claims.

I claim:

1. Apparatus for producing a plurality of corrugations in the flange region of metallic can bodies comprising a starwheel for carrying said can bodies to and from a work station, means for indexing said starwheel, an inner rotatable grooved die at said work station, motor means connected to said inner rotatable grooved die to rotate said inner rotatable grooved die, a free wheeling pivotable outer rotatable grooved die, piston means for positioning said flange region of said can bodies between said inner rotatable grooved die and said outer rotatable grooved die and cam means for selectively operatively associating said outer rotatable grooved die with said flange region of said can bodies and said inner rotatable grooved die to thereby rotate said can bodies and said outer rotatable grooved die and produce said corrugating in said flange region of said can bodies.

* * * * *